United States Patent [19]

Ono et al.

[11] Patent Number: 4,591,322

[45] Date of Patent: May 27, 1986

[54] ECCENTRIC ARCHIMEDIAN SCREW PUMP OF ROTARY DISPLACEMENT TYPE

[75] Inventors: Tsuneo Ono; Yukinori Nakamura, both of Kobe, Japan

[73] Assignee: Heishin Sobi Kabushiki Kaisha, Kobe, Japan

[21] Appl. No.: 687,011

[22] Filed: Dec. 28, 1984

[30] Foreign Application Priority Data

Dec. 28, 1983 [JP] Japan ..... 58-247791
Dec. 29, 1983 [JP] Japan ..... 58-245709
Feb. 28, 1984 [JP] Japan ..... 59-037468

[51] Int. Cl.[4] ..... F04C 2/00; F04C 5/00; F04C 15/00

[52] U.S. Cl. ..... 418/48; 418/182

[58] Field of Search ..... 418/48, 182

[56] References Cited

U.S. PATENT DOCUMENTS 2,525,265 10/1950 Moineau ..... 418/48

FOREIGN PATENT DOCUMENTS 1213742 3/1966 Fed. Rep. of Germany ..... 418/48
1944562 3/1971 Fed. Rep. of Germany ..... 418/48

*Primary Examiner*—John J. Vrablik
*Attorney, Agent, or Firm*—Marshall, O'Toole, Gerstein, Murray & Bicknell

[57] ABSTRACT

This disclosure relates to a pump including a stator formed with a spiral pump cavity therethrough, which is generally oval in cross section, and a spiral pump rotor which is generally circular in cross section and extends through the cavity. The rotor has a shaft fixed thereto and the axis of the shaft is eccentrically located from the centerline of the spiral cavity by a distance e, so that the shaft makes a hypocycloidal motion with its axis orbiting in a circle having a radius equal to the distance e. The pump further includes a drum journalled concentrically with the spiral cavity. The shaft is journalled on the drum in parallel with the drum axis but eccentrically therefrom by the distance e.

2 Claims, 14 Drawing Figures

FIG. 5a
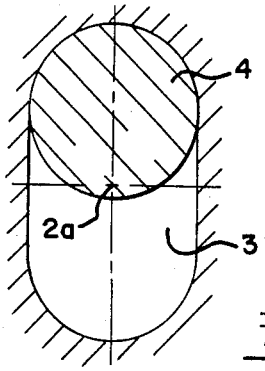
FIG. 5b
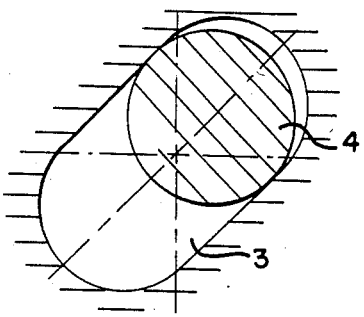
FIG. 5c
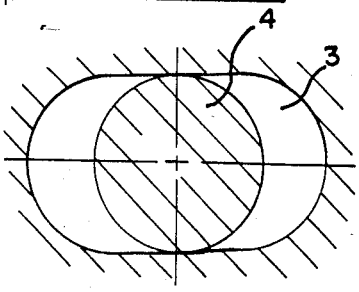
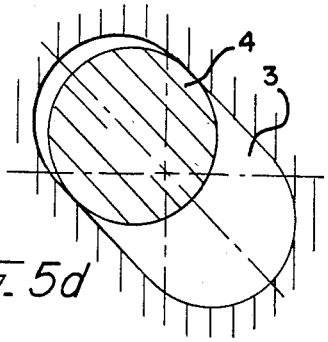
FIG. 5d
FIG. 6a
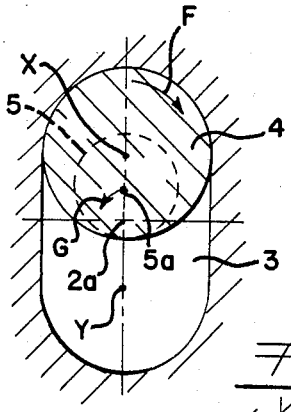
FIG. 6c
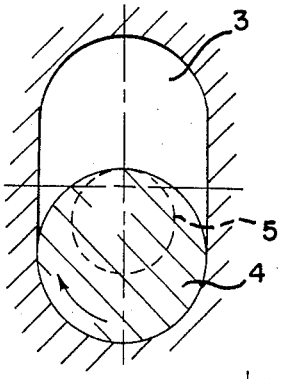
FIG. 6b
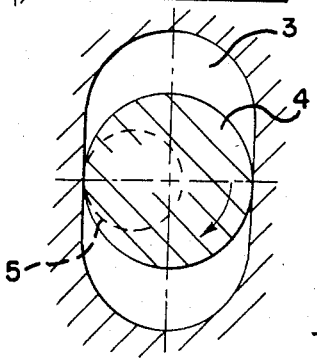
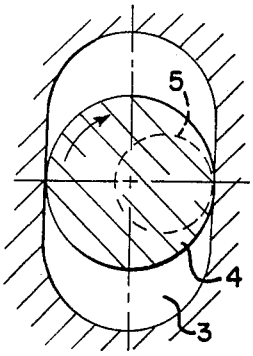
FIG. 6d 32
22
23
21
24
11
12
12'
33
20
13
15
D
14
B
5
2a
2
3
4
A
C
4e
e
5a
23
21
22

ECCENTRIC ARCHIMEDIAN SCREW PUMP OF ROTARY DISPLACEMENT TYPE

BACKGROUND OF THE INVENTION

The present invention relates to an eccentric Archimedian screw pump of the rotary displacement type (sold under the trademark MOHNO PUMP). A prior art pump of this type is shown in FIG. 1 of the accompanying drawings, and, for example, in Japanese Patent Provisional Publication No. 51-13404 laid open on Feb. 2, 1976, claiming priority of German Patent Application No. P 24 29 340.1 filed on June 19, 1974.

In FIG. 1, the pump assembly includes a pumping section A, an inlet B, an outlet C and a drive Section D. The pumping section includes an elastic stator 2 having a pump cavity in the shape of a spiral female thread 3, and a pump rotor 4 in the shape of a spiral male thread which is in rotatable engagement within the thread 3. The drive section D includes a drive shaft 20 supported by bearings on the pump housing. The rotor 4 is rotatable eccentrically of the shaft 20, and connected with it through a pair of universal joints 50 and a connecting rod 51. This arrangement results in an increased length of the pump.

The foregoing arrangement has a number of disadvantages in addition to that of the increased length. The rotor motion is confined only by the inner wall of the thread 3, with the connecting rod 51 rotating out of parallel with the pump axis. As a result, the rotor 4 may rotate unstably and may swing outside the normal path, thereby fatiguing the inner wall of the thread 3.

In addition, the universal joint 50 which is generally located adjacent the inlet end of the stator cavity, increases the resistance to the flow of the pumped medium into the cavity. Further, long and solid objects in the medium may be caught around this joint.

BRIEF SUMMARY OF THE INVENTION

It is a general object of the invention to provide a compact pump of the foregoing type, which has a stable and smooth rotor motion, and which applies less load on the wall of the spiral cavity of the stator.

A pump in accordance with the invention includes a stator formed with a spiral pump cavity therethrough, which is generally oval in cross section, and a spiral pump rotor which is generally circular in cross section and extends through the cavity. The rotor has a shaft fixed thereto and the axis of the shaft is eccentrically located from the centerline of the spiral cavity by a distance e, so that the shaft makes a hypocycloidal motion with its axis orbiting in a circle having a radius equal to the distance e. The pump further includes drive means journalled concentrically with the spiral cavity. The shaft is journalled on the drum in parallel with the drum axis but eccentrically therefrom by the distance e.

BRIEF DESCRIPTION OF THE DRAWINGS

The invention will be better understood from the following detailed description of preferred embodiments of the invention, taken in conjunction with the accompanying figures of the drawings, wherein:

FIGS. 5*a* to 5*d* are diagrammatic views in cross section taken at various axially spaced points in FIG. 4;

FIGS. 6*a* to 6*d* are views similar to FIG. 3, but showing a time sequence of the rotor motion at a single axial point;

DETAILED DESCRIPTION OF THE DRAWINGS

Figure 2:
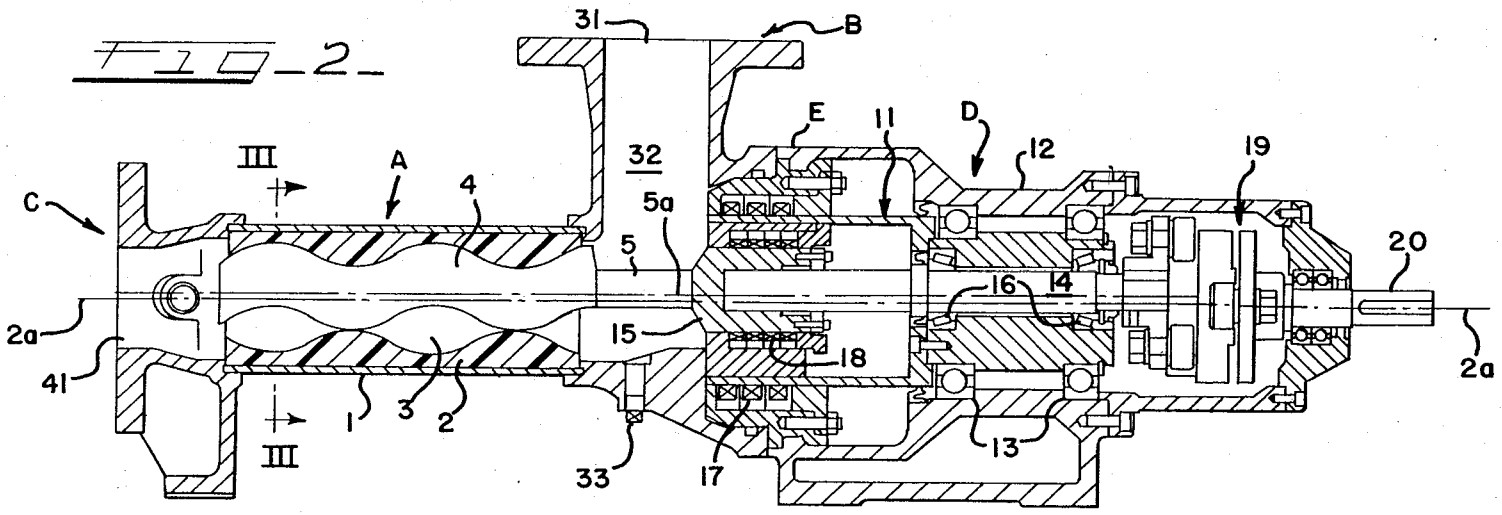
FIG. 2 is a side view in axial section of a pump in accordance with one form of the present invention.

In FIG. 2, the pump assembly includes a conventional pumping section A, which bridges an inlet section B and an outlet section C, and a drive section D on the side of the inlet B opposite the section A. The housing E of the pump forms the inlet B which has an upwardly facing opening 31 communicating with an inlet passage 32, and a drain cock 33 may be provided at the bottom of the housing E below the passage 32. The outlet C is formed by an opening 41 of the housing E.

The pumping section A includes a cylindrical housing part 1 that encloses and supports an elastic stator 2 which is fixed to the part 1. The stator has a spiral pump cavity 3 therein, which is substantially oval in cross section (see FIG. 3) and which extends between the inlet passage 32 and outlet C. Mounted for rotation within the cavity 3 is a spiral rotor 4, which is substantially circular in cross section and forms a single spiral or helix.

Figure 1:
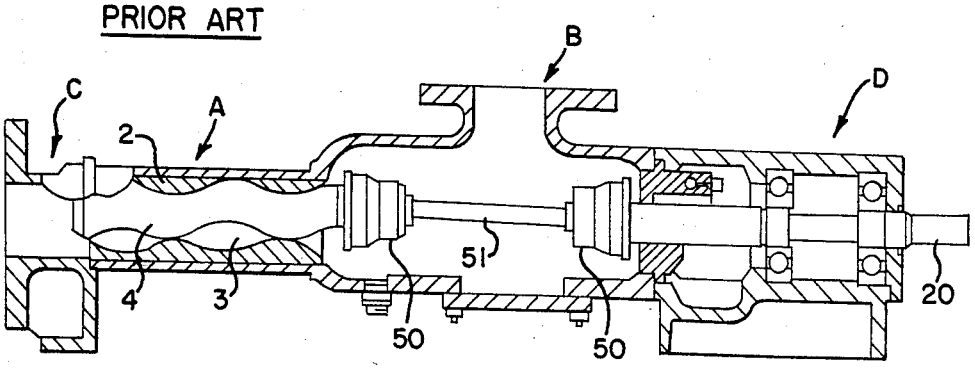
FIG. 1 PRIOR ART
FIG. 1 is a side view in axial section showing a prior art pump.
Figure 3:
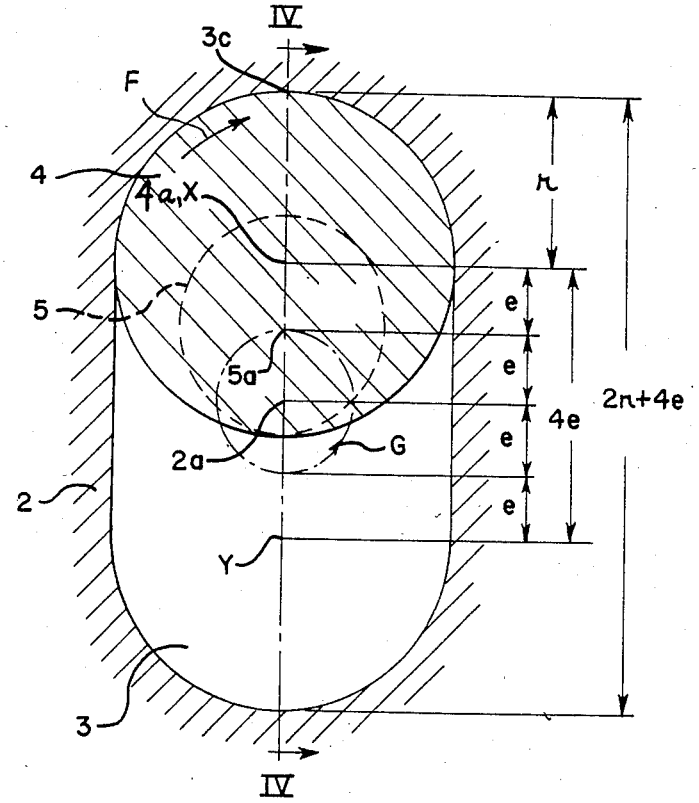
FIG. 3 is an enlarged diagrammatic view in cross section, taken on the line III—III in FIG. 2.

The cross-sectional centerline of the cavity 3 lies on the stator axis 2*a* (FIGS. 2, 3 and 5*a*). The cavity 3 forms a spiral but it extends equal distances on opposite sides of the axis, thereby forming a double spiral. As shown in FIG. 3, the cross section of the cavity 3 has semi-circular end portions and straight portions bridging the end portions. These semicircular end portions of the cavity 3 and the cross section of the rotor 4 have the same radius r. The centers of the two end portions are marked X and Y, and the distance between the centers X and Y, which is also the length of the straight portions, is 4*e*. The pitch of the spiral cavity 3 may be larger than that of the spiral rotor 4, and it is twice in this instance.

The rotor 4 has a shaft 5 fixed to its end which is adjacent the inlet section B. The axis 5*a* (FIGS. 2 and 3) of the shaft 5 is offset or eccentric from the cross-sectional center 4*a* of the rotor 4 and from the stator axis 2*a* by the distance e. With reference to FIGS. 3, 6*a* and 6*c*, when the rotor 4 contacts an endmost point 3*c* of the cavity 3, the center 5*a* of the shaft 5 is located at the midpoint of a line drawn from the stator axis 2*a* to the center X (see FIG. 3).

Figure 4:
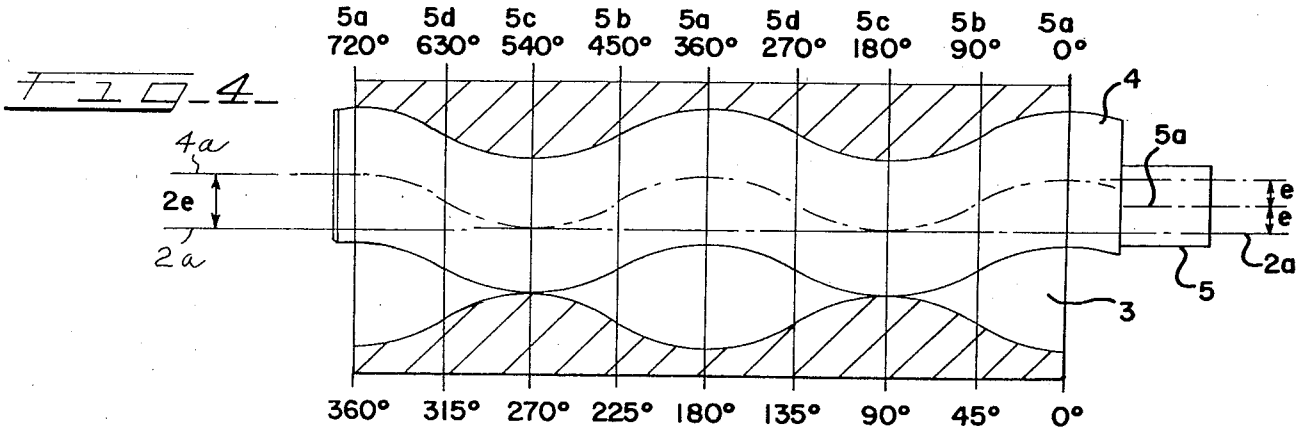
FIG. 4 is an enlarged diagrammatic view in axial section taken on the line IV—IV in FIG. 3.

FIGS. 5*a* to 5*d* show the configuration of the cavity 3 and the location of the rotor 4 in cross section at various axial locations of the cavity 3 as shown in FIG. 4; FIG. 5*a* is at 0, 360 and 720 degrees; FIG. 5*b* is at 90 and 450 degrees; FIG. 5*c* at 180 and 540 degrees; and FIG. 5*d* at 270 and 630 degrees.

As shown in FIGS. 6*a* to 6*d*, one full revolution of the rotor 4 and the eccentric shaft 5 on their respective axes in a direction F causes the rotor 4 to reciprocate in sliding engagement with the sides of the cavity 3 in one cycle, with the center of the rotor reciprocating between the points X and Y (FIGS. 3 and 6*a*). This also causes one cycle of hypocycloid motion of the eccentric shaft 5, with its axis 5*a* orbiting in the opposite direction G in a circle following the dash-dot line in FIG. 3, which has a radius equal to the distance e around the stator axis 2*a*.

Thus, a substance filling the space between the wall of the cavity 3 and the rotor 4 is driven continuously toward the outlet end C by a consistent and endless piston movement.

With reference again to FIG. 2, the drive section D includes a crank drum 11 journalled by bearings 13 on a housing part 12, which is fixed relative to the housing part of the pumping section A. The drum 11 axis is aligned with the stator axis 2*a*. The drum 11 has a crankshaft or eccentric shaft 14, which may be considered as a part of the shaft 5. The shaft 14 journalled on the interior of the drum 11 through bearings 16 with the shaft axis eccentric from the drum axis by the distance e. The shaft 14 is secured to the shaft 5 by a joint 15 with their axes in alignment.

Packings 17 are provided between the forward (toward the left as seen in FIG. 2) outer wall of the drum 11 and the inner wall of the housing part 12. Packings 18 are provided between the forward inner wall of the drum 11 and the outer wall of the coupling 15. The spaces within the housing to the rearward of the packings 17 and 18 communicate with the atmosphere through drain holes (not shown).

The rear end of the eccentric shaft 14 is coupled through a break joint 19 to a drive shaft 20, which is journalled by bearings on the housing part 12 and is aligned with the stator axis 2*a*. The joint 19 may be, for example, an Oldham's coupling, a crank coupling, an angle joint, a universal joint, a hook joint or the like.

In operation, with reference to FIG. 2, the drive shaft 20 is adapted to be coupled to a prime mover and to rotate the joint 19, the eccentric shafts 14 and 5 and the rotor 4. This rotation produces a rotor motion as previously described. As a result, the shafts 5 and 14 orbit in a circle (FIGS. 3, 6*a* to 6*d*) in the direction opposite their rotation on their own axis, which is eccentric from the stator axis 2*a* or the drum axis by the distance e. The orbital motion rotates the drum 11.

Thus, the eccentric shaft 5 rotates and orbits in parallel with the stator axis 2*a*. This stabilizes the rotor motion.

As a modification, the rotor 4 may also have an eccentric shaft 5 fastened to it on the outlet C end, which would be journalled by means similar to the drum 11 but which would not be driven.

Figures 7, 8:
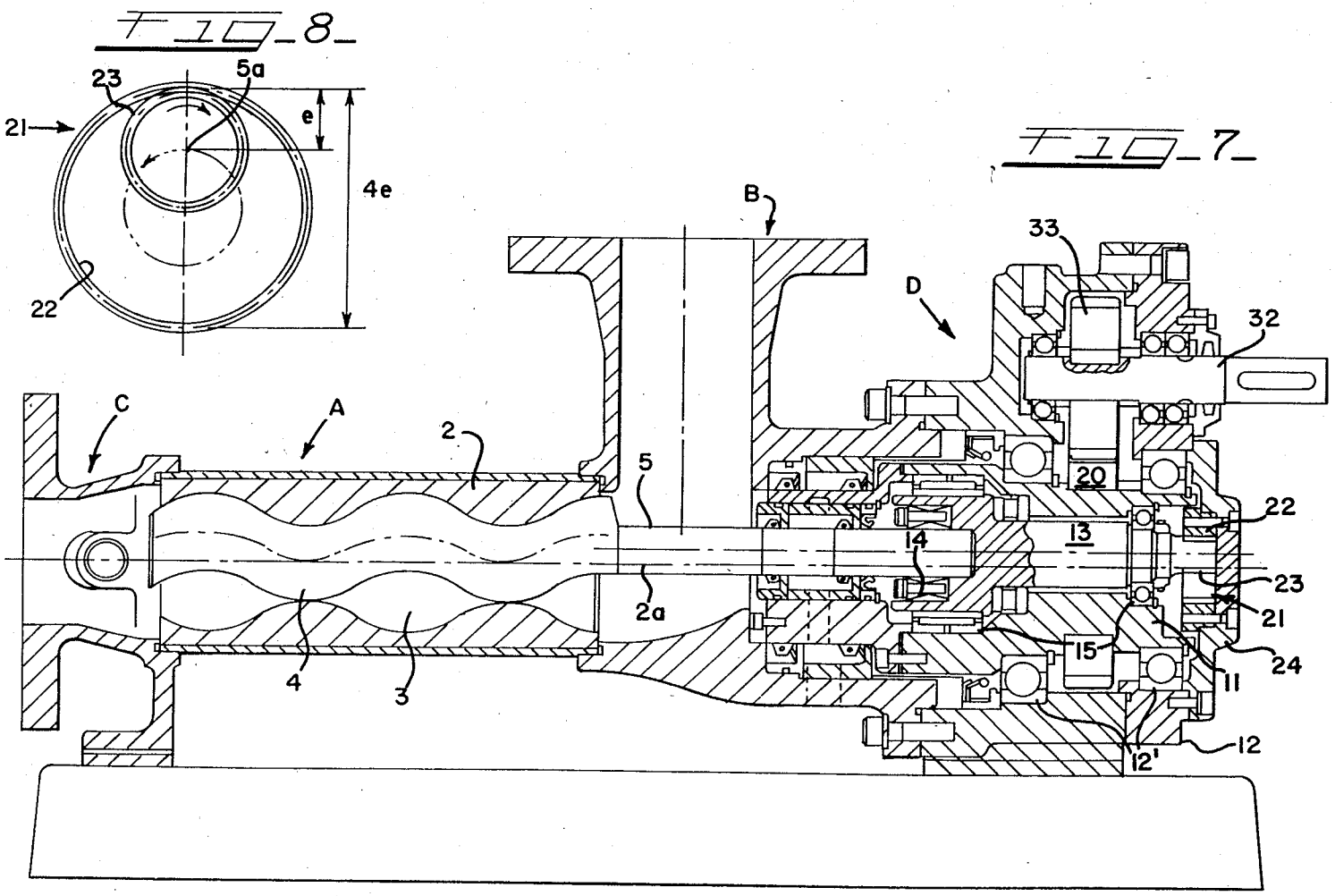
FIG. 7 is a side view in axial section of a pump in accordance with another embodiment of the invention.
FIG. 8 is an enlarged diagrammatic view of a Cardan circle gear used in FIG. 7.

In the second embodiment shown in FIG. 7, the pumping, inlet and outlet sections A–C are substantially the same as the corresponding parts shown in FIG. 2.

In FIG. 7, the eccentric rotor shaft 5 is coupled by a keyless joint 14 with a crankshaft 13 as a part of the shaft 5. The shaft 13 is journalled on the interior of a crank drum 11 with their axes offset or spaced from each other by the distance e, as in the first embodiment of the invention. The drum 11 is journalled by bearings 12' on the housing 12, with the drum 11 axis aligned with the stator axis 2*a*.

The drum 11 has a pinion 20 fixed to its outer periphery that meshes with a pinion 33 which is fixed to a drive shaft 32 journalled on the housing 12.

Provided at the rear end of the drum 11 and the shaft 13 is a Cardan circle gear 21 (FIGS. 7 and 8), which includes an internal gear 22 and a pinion 23. The pitch circle of the internal gear 22 has a radius of twice the distance e, while that of the pinion 23 has a radius of the distance e. The internal gear 22 is fixed to the housing 12 through an end cover 24 concentrically with the drum 11 and stator 2. The pinion 23 is formed concentrically on the rear end of the eccentric shaft 13, and engages the internal gear 22.

In operation, the drive shaft 32 rotates the drum 11 through the pinions 20 and 33. The drum 11 forces the eccentric shafts 13 and 5 to orbit in a circle with the radius e around the stator axis 2*a* (FIG. 6). This creates a motion of the rotor 4 in engagement with the stator cavity 3 in the same manner as in the first embodiment. As a result, with reference to FIG. 6, the rotor 4 rotates in the direction F opposite to the orbital direction G of the shaft 5.

As the eccentric shafts 13 and 5 orbit, the pinion 23 of the Cardan circle gear is forced to rotate in engagement with the internal gear 22 (FIG. 8) in the direction opposite the orbital motion. These rotational and orbital motions of the pinion 23 conform with those of the eccentric shafts which are created by the motion of the rotor 4.

Thus, the Cardan circle gear 21 confines the shafts 13 and 5 to the precise hypocycloid motion as mentioned above with reference to FIG. 6, regardless of the existence of the stator 2. This prevents the wall of the cavity 3 from being loaded by the rotor 4 and consequently worn out. Also, the stator may be made of a wide variety of materials including metal, and it is possible to improve the dimensional accuracy of the cavity and the rotor.

What is claimed is:

1. An eccentric Archimedian screw pump of the rotary displacement type, comprising a stator having a spiral cavity formed therethrough, said cavity having a longitudinally extending centerline and being substantially oval in cross section, a spiral rotor positioned in said cavity, said rotor being substantially circular in cross section and having a centerline, a shaft connected to said rotor and rotatably mounted eccentrically from said centerline of said rotor by a distance e, a drum mounted for rotation concentrically with said cavity centerline, means journalling said shaft on said drum but eccentrically from the drum axis by said distance e, drive means rotatable substantially on said centerline of said cavity, and a break joint forming a direct coupling between said drive means and said shaft.

2. A pump comprising a housing, a stator mounted in said housing and having a spiral cavity formed therethrough, said cavity having a longitudinally extending centerline and being substantially oval in cross section, a spiral rotor positioned in said cavity, said rotor being substantially circular in cross section and having a spiral centerline, said cavity having a first end and a second end and said housing having flow openings formed therein adjacent said first and second ends, drive means mounted in said housing for rotation on an axis that is substantially coaxial with said centerline of said cavity, a shaft secured to said rotor adjacent said first end, and a break joint forming a direct coupling of said shaft with said drive means, said shaft being moved in a hypocycloidal motion when said drive means is rotated, said shaft having an axis which is eccentric from said spiral centerline of said rotor by the distance e and is eccentric from said centerline of said cavity by said distance e, a drum rotatably mounted in said housing on said cavity axis and rotatably supporting said shaft, and said shaft extends at least partially through said drum.

* * * * *